US005535657A

United States Patent [19]

Bystrom

[11] Patent Number: 5,535,657

[45] Date of Patent: Jul. 16, 1996

[54] DEVICE FOR PERFORATING PAINT CAN LIDS

[76] Inventor: Phillip L. Bystrom, 270 Caliban Ct., Encinitas, Calif. 92024

[21] Appl. No.: 391,576

[22] Filed: Feb. 6, 1995

[51] Int. Cl.[6] ..... B26F 1/00

[52] U.S. Cl. ..... 83/745; 30/361; 30/366; 83/660

[58] Field of Search ..... 30/358, 361, 366, 30/314, 315; 81/3.48; 7/151, 152; D8/33, 40, 41; 83/745, 660

[56] References Cited

U.S. PATENT DOCUMENTS

| | | | |
|---|---|---|---|
| 952,170 | 3/1910 | Zeese | D8/40 |
| 1,024,403 | 4/1912 | Hill | 81/3.48 |
| 1,396,629 | 11/1921 | Hand | 81/3.48 |
| 3,043,171 | 7/1962 | Lederer | 81/3.48 |
| 4,580,302 | 4/1986 | Barth | 7/152 |
| 5,154,102 | 10/1992 | Becker | 81/3.48 |

*Primary Examiner*—Kenneth E. Peterson

[57] ABSTRACT

A dome shaped tool is provided for use with a standard one gallon and one quart adapted to be positioned over the sealing ring groove in the paint can. This tool includes 4 equally spaced guide/puncture tips which are attached to the underside an inside of the dome and extended downward.

1 Claim, 1 Drawing Sheet

DEVICE FOR PERFORATING PAINT CAN LIDS

BACKGROUND OF THE INVENTION

1. Field of the Invention

The instant invention relates to paint cans, specifically a device that provides a means to simultaneously punch 4 evenly spaced holes in the sealing ring groove. Paint cannot then accumulate in the groove; it will drain back into the can, thus allowing for a clean replacement of the lid.

2. Description of the Related Art

Numerous devices have been provided that are adapted to perform different types of functions. While these devices are suitable for a particular purpose they do not address the problems of the instant invention.

U.S. Pat. No. 4,580,302 issued to James Barth on Apr. 8, 1986 describes a tool for a paint can structured to provide a single punched hole in the paint can lid gutter so that the paint will drain back into the can.

SUMMARY OF THE INVENTION

The instant invention is a stamped steel dome shaped device, the purpose of which is to make four simultaneous puncture holes in the bottom of the sealing ring groove on a standard one gallon and one quart paint container after the lid is removed. The dome device has 4 equally spaced guide/puncture tips attached to the underside and inside of the dome rim. The guides fit over the outside perimeter of the paint can so that the puncture tips line up directly over the sealing groove in the paint can body. A striking blow to the top of the dome body drives the entire device downward compressing the springs that surround the puncture tips. This causes the four puncture tips to protrude through the contour sealing rim and therefore to puncture the bottom of the sealing ring groove. The compressed springs then returns the device to its original uncompressed state with the puncturing tips unexposed. The purpose of the device is to allow paint to drain back into the can, instead of accumulating in the rim or overflowing down the outside of the can. Opening and closing the paint can is more easily performed without accumulated paint in the rim of the can which would lessen the chance of an airtight seal.

DETAILED DESCRIPTION OF THE INVENTION

Figure 1:
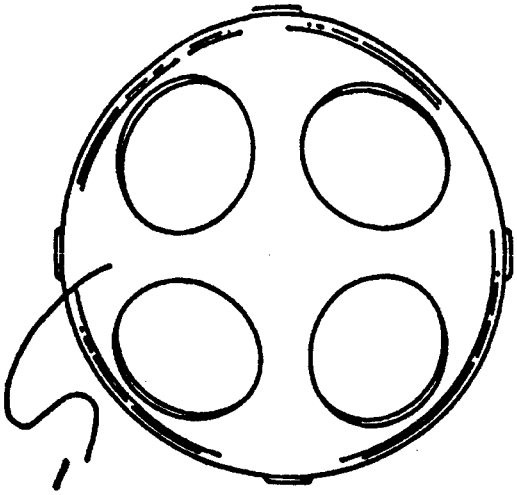
FIG. 1 is a top plan view of the metal dome.
Figure 2:
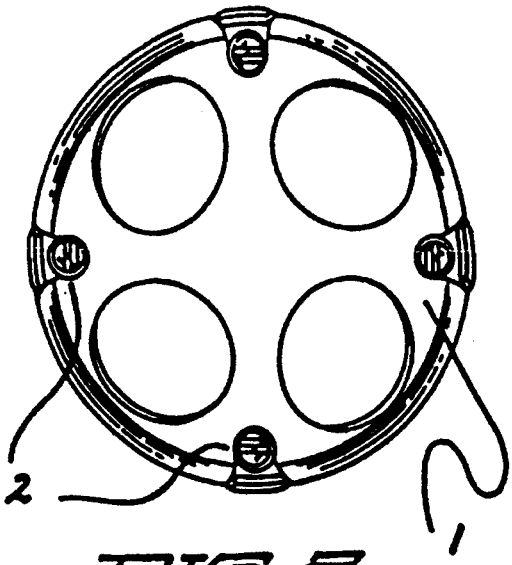
FIG. 2 is a bottom view of the metal dome.
Figure 3:
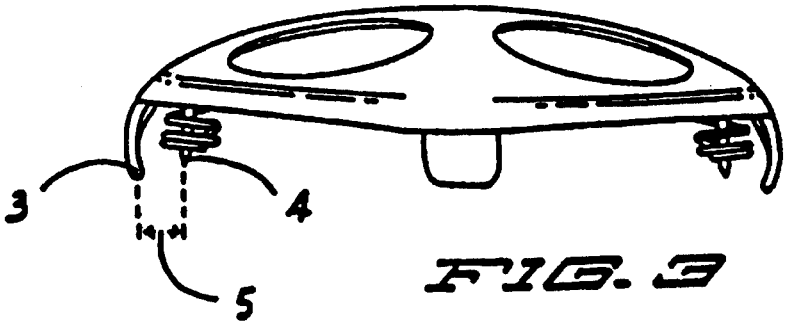
FIG. 3 is a side elevation of the metal dome.

Referring first to FIG. 1 and FIG. 2, which show the top and bottom view of the instant invention, the body portion of which is indicated as 1, which is a dome made of steel which is slightly larger in diameter than the paint can it will fit over to be used. In FIG. 2 the underside of the engaging means/punching means with spring assembly is indicated as 2, these four assemblies are welded to the underside of the dome at its outer edge and are spaced equidistant from one another on the perimeter of the body. FIG. 3 is a side view of the instant invention which clearly shows the engaging means 3 and punching means with spring assemblies 4 descending from the underside of the outside perimeter of the body 1, and it shows the gap 5 which exists between the two descending parts. It is this gap 5 which aligns the punching means over the sealing ring groove on the paint can when the tool is placed on top of the can after its lid has been removed and the four engaging means 3 prongs have made contact with the outside perimeter of the paint can.

Figure 4:
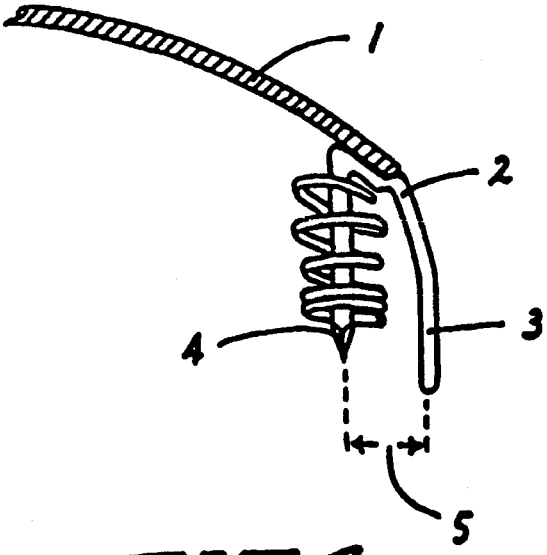
FIG. 4 is a detailed view of the guide/puncture tip/spring assembly.
Figure 5:
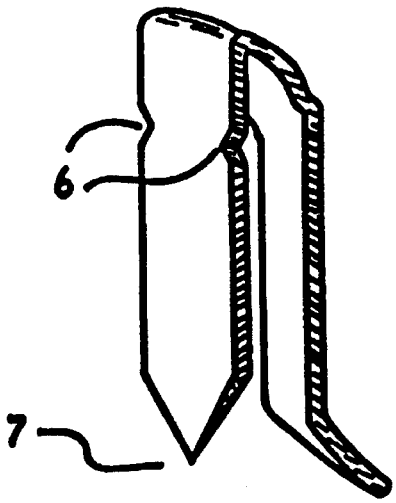
FIG. 5 is a detailed view of the engaging means/punching means tip.

FIG. 4 is a cross section view of one of the engaging means/punching means with spring assemblies 2 showing its relationship with the body 1, it also makes clear the gap 5 between the punching means with spring 4 and the engaging means 3. FIG. 5 is a view of the engaging means/punching means 2 without the spring which is installed by sliding said spring onto the punching means until it engages the notches 6 that are cut into the punching means when the whole part is made of sheet steel. The punching means tip 7 is sharpened before the part is formed into the contour indicated in the side view 2 in FIG. 4.

I claim:

1. A tool for punching a plurality of spaced holes in a sealing ring groove of a paint can when a lid of said can has been removed comprising:

(a), a dome shaped body portion;

(b), a plurality of spaced apart prongs extending downwardly from an underside of said body portion;

(c), each said prong comprising punching means having a sharp edge at one end thereof and engaging means spaced apart from said punching means to define a gap between the sealing ring groove and an outside perimeter of the paint can; and (d), whereby when said body portion is positioned on the paint can said engaging means contacts said outside perimeter of said paint can and aligns said punching means over the sealing ring groove, and when said punching means are forced downwardly on the sealing ring groove said punching means sharp edges enter the sealing ring groove to puncture a plurality of holes.

* * * * *